US005477030A

United States Patent [19]

Buckshaw et al.

[11] Patent Number: 5,477,030

[45] Date of Patent: Dec. 19, 1995

[54] COOKING APPARATUS, LATCHING CONSTRUCTION THEREFOR AND METHODS OF MAKING THE SAME

[75] Inventors: Thomas M. Buckshaw, Indiana; David D. Martin, Dunbar; Eric V. Russ, Gibsonia, all of Pa.

[73] Assignee: Robertshaw Controls Company, Richmond, Va.

[21] Appl. No.: 229,378

[22] Filed: Apr. 18, 1994

[51] Int. Cl.[6] ..... F24C 7/08; H05B 1/02

[52] U.S. Cl. ..... 219/413; 219/724; 126/197; 200/50 A; 292/DIG. 69

[58] Field of Search ..... 219/722, 723, 219/724, 412, 413, 414; 200/50 A, 50 R, 61.62, 61.76, 61.78, 61.81; 292/DIG. 69, 261; 126/192, 197

[56] References Cited

U.S. PATENT DOCUMENTS

| | | | |
|---|---|---|---|
| 3,784,776 | 1/1974 | Asanuma | 219/724 |
| 3,805,528 | 4/1974 | Huebscher | 60/530 |
| 4,095,427 | 6/1978 | Stropkay | 60/530 |
| 4,887,429 | 12/1989 | Birli, Sr. et al. | 60/527 |
| 4,901,474 | 2/1990 | Bayard et al. | 292/144 |
| 4,927,996 | 5/1990 | Genbauffe et al. | 219/413 |
| 4,935,989 | 6/1990 | Miller | 16/66 |
| 4,951,693 | 8/1990 | Archambault | 292/DIG. 69 |
| 5,293,666 | 3/1994 | Armstrong | 16/66 |

*Primary Examiner*—Philip H. Leung
*Attorney, Agent, or Firm*—Fulbright & Jaworski

[57] ABSTRACT

A cooking apparatus, a latching construction therefor and methods of making the same are provided, the latching construction comprising a frame carrying a movable latch member and a drive unit operatively interconnected to the latch member to move the latch member between the latching and unlatching positions thereof, the drive unit comprising a cylinder having opposite ends and a movable piston extending from one of the opposite ends and being operatively interconnected to the latch member, the drive unit having an actuator to extend the piston so as to be adapted to move the latch member to its latching position thereof and to retract the piston so as to be adapted to move the latch member to the non-latching position thereof.

16 Claims, 3 Drawing Sheets

COOKING APPARATUS, LATCHING CONSTRUCTION THEREFOR AND METHODS OF MAKING THE SAME

BACKGROUND OF THE INVENTION

1. Field of the Invention

This invention relates to a new cooking apparatus and to a new door latching construction for such a cooking apparatus as well as to a new method of making such a cooking apparatus and to a new method of making such a door latching construction.

2. Prior Art Statement

It is known to provide a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in its closed position and actuates the switch means if the door means is in its closed position at the time the latch member is moved to the latching position thereof, and drive means carried by the frame means and having moving means operatively interconnected to the latch member to move the latch member between the positions thereof only when the moving means of the drive means moves from a first position thereof to a second position thereof, the drive means comprising an electrical motor. For example, see the Genbauffe et al, U.S. Pat. No. 4,927,996.

It is also known to provide an electro-thermal drive means wherein the same comprises a cylinder means having opposite ends and a movable piston means extending from one of the opposite ends, the drive means having actuating means to extend the piston means to an extended position thereof and to retract the piston means so as to be in a non-extended position thereof. For example, see the Huebscher U.S. Pat. No. 3,805,528; the Stropkay U.S. Pat. No. 4,095,427 and the Birli, Sr. et al, U.S. Pat. No. 4,887,429.

SUMMARY OF THE INVENTION

It is one of the features of this invention to provide a new drive means for uniquely operating the movable latch member of a door latching construction of a cooking apparatus.

In particular, it has been found according to the teachings of this invention that a piston and cylinder type of drive means can be uniquely arranged to operate the movable latch member of the latching construction whereby a relatively inexpensive drive means is provided in contrast to the expensive electrical motor means previously utilized.

For example, one embodiment of this invention comprises a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in the closed position and actuates the switch means if the door means is in its closed position at the time the latch member is moving to the latching position thereof, and drive means carried by the frame means and having moving means operatively interconnected to the latch member to move the latch member between the positions thereof only when the moving means of the drive means moves from a first position thereof to a second position thereof, the drive means comprising a cylinder means having opposite ends and a movable piston means extending from one of the opposite ends and comprising the moving means operatively interconnected to the latch member, the drive means having actuating means to extend the piston means so as to be adapted to move the latch member to its latching position thereof and to retract the piston means so as to be adapted to move the latch member to its non-latching position thereof.

Accordingly, it is an object of this invention to provide a new cooking apparatus having one or more of the novel features of this invention as set forth above or hereinafter shown or described.

Another object of this invention is to provide a new method of making such a cooking apparatus, the method of this invention having one or more of the novel features of this invention as set forth above or hereinafter shown or described.

Another object of this invention is to provide a new latching construction for a cooking apparatus, the latching construction of this invention having one or more of the novel features of this invention as set forth above or hereinafter shown or described.

Another object of this invention is to provide a new method of making such a latching construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
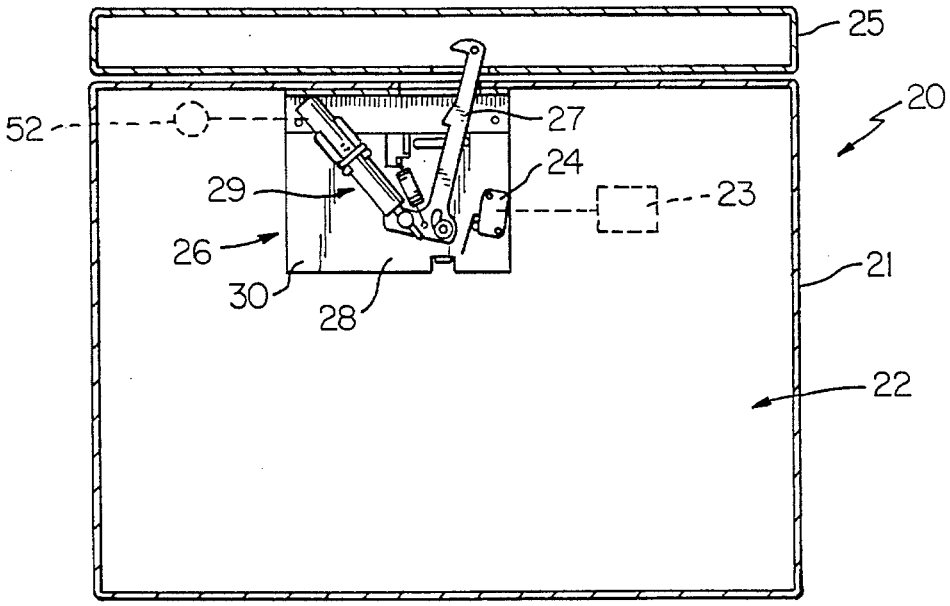
FIG. 1 is a schematic cross-sectional view illustrating the new cooking apparatus of this invention utilizing the new door latching construction of this invention, the door means of the cooking apparatus being in its closed position and the latch member of the latching construction being in its non-latching position.

While the various features of this invention are hereinafter described and illustrated as being particularly adapted to provide a door latching construction for a particular cooking apparatus, it is to be understood that the various features of this invention can be utilized singly or in various combinations thereof to provide a door latching construction for other types of cooking apparatus as desired.

Therefore, this invention is not to be limited to only the embodiment illustrated in the drawings, because the drawings are merely utilized to illustrate one of the wide variety of uses of this invention.

Referring now to FIG. 1, a new cooking apparatus of this invention is generally indicated by the reference numeral 20 and comprises a frame means 21 carrying a cooking chamber means 22 and a heating means 23 that is adapted to be actuated to heat clean the chamber means 22 in a manner well known in the art. An electrical switch means 24 is carried by the frame means 21 in a manner hereinafter set forth and permits the heating means 23 to heat clean the chamber means 22 only when the switch means 24 is actuated to a certain condition thereof.

Figure 6:
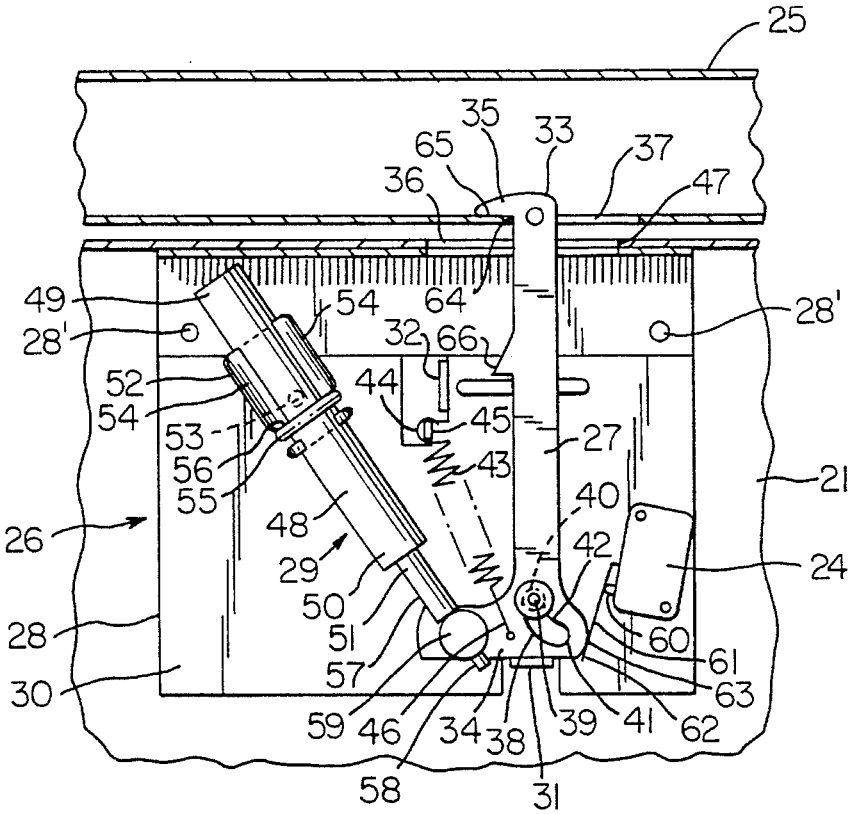
FIG. 6 is a view similar to FIG. 4 and illustrates the latching member having been moved to its fully latching position by the drive means of the latching structure of FIG. 1.
Figure 7:
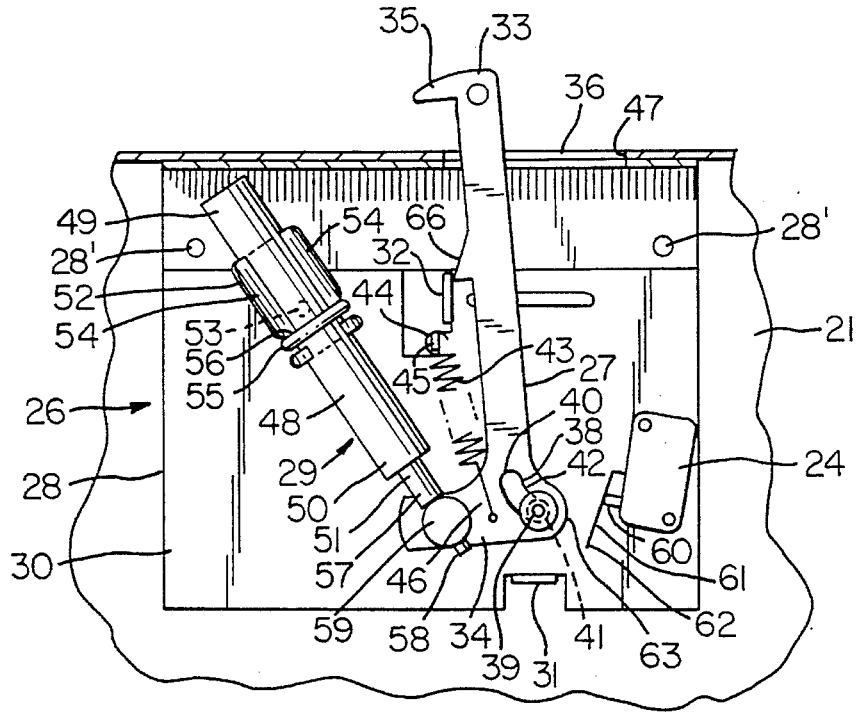
FIG. 7 is a view similar to FIG. 2 and illustrates the latching member hating been moved to a third position thereof when the oven door means is in its open position and the drive means for the latch member tends to move the latch member from its non-latching position to its latching position.

The cooking apparatus 20 has a movable door means 25 that is movably carried by the frame means 21 in a conventional manner for opening and closing the cooking chamber means 22, the door means 25 being shown in its closed condition in FIGS. 1, 2, 3, 4 and 6 and in its open condition in FIG. 7.

Figure 3:
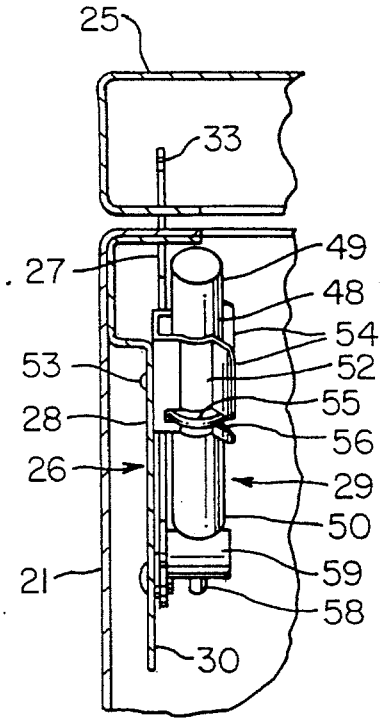
FIG. 3 is a fragmentary cross-sectional view taken on line 3—3 of FIG. 2

A new door latching construction of this invention is generally indicated by the reference numeral 26 and is carried by the frame means 21 of the cooking apparatus 20 in a manner hereinafter set forth, the latching construction 26 comprising a movable latch member 27 carried by a frame means 28 that forms part of the frame means 21 and can be spot welded thereto in the manner illustrated by the reference numerals 28' in FIG. 2 to position the frame means 28 as illustrated in FIG. 3.

Figure 2:
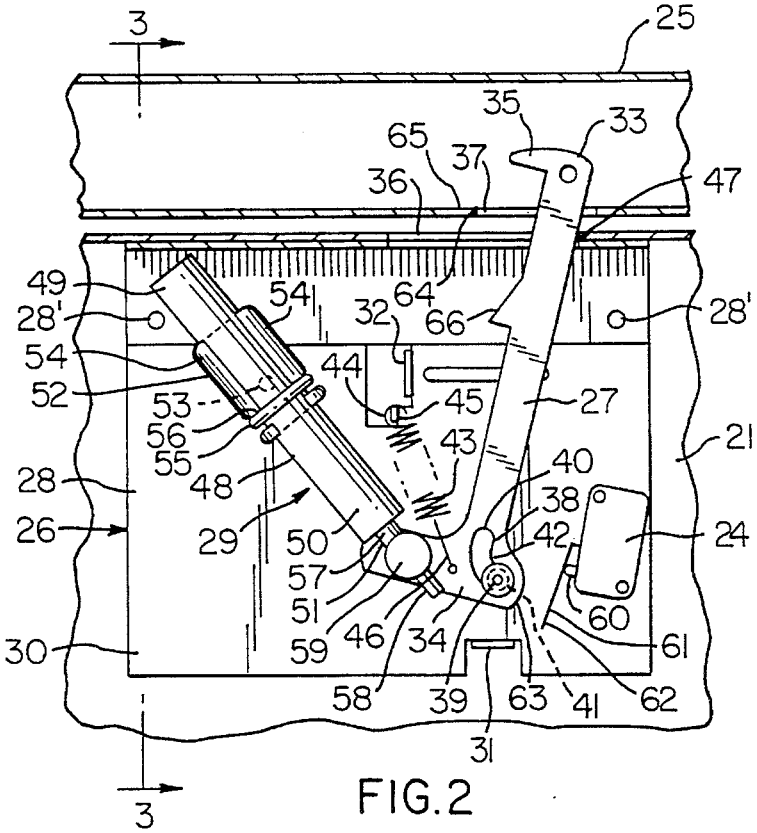
FIG. 2 is an enlarged fragmentary view of the latching structure of FIG. 1.

The latch member 27 is operatively interconnected to a drive means of this invention that is generally indicated by the reference numeral 29 in the drawings, the latch member 27 being movable between a non-latching position thereof as illustrated in FIG. 2 that permits the door means 25 to be opened and closed as desired and a latching position thereof as illustrated in FIG. 6 that locks the door means 25 in its closed condition if, at the time the latch member 27 is moved to the latching position thereof by the drive means 29, the door means 25 is in its closed condition as will be apparent hereinafter. However, the latch member 27 is moved from its non-latching position directly to a third position thereof as illustrated in FIG. 7 by the drive means 29 when the drive means 29 tends to move the latch member 27 to the latching position thereof when the door means 25 is not in a closed condition thereof as will be apparent hereinafter.

The latch member 27 and the electrical switch means 24 are so disposed on the frame means 28 of the cooking apparatus 20 that the switch means 24 is only actuated by the latch member 27 when the latch member 27 is moved to its latching position as illustrated in FIG. 6 and is not actuated when the latch member 27 is moved to its third position as illustrated in FIG. 7 as will also be apparent hereinafter.

Thus, it can be seen that the general operation of the latching construction 26 previously described is fully set forth in the aforementioned Genbauffe et al, U.S. Pat. No. 4,927,996 whereby this U.S. patent is being incorporated into this disclosure by this reference thereto.

The frame means 28 of the latching construction 26 comprises a plate 30 formed of any suitable material, such as metallic material, and having a pair of spaced apart tangs 31 and 32 carved therefrom and suitably bent to provide abutment means for a purpose hereinafter set forth.

The latch member 27 comprises a one piece member formed of any suitable material, such as metallic material, and having opposed ends 33 and 34, the end 33 having a hook 35 and being adapted to project out of an opening means 36 formed through the frame means 28, 21 so as to be received in an opening means 37 formed in the side of the door means 25 as illustrated in FIG. 2 when the door means 25 is in its closed condition thereof and the latch member 27 is in the non-latching position thereof.

The end 34 of the latch member 27 has a slot means 38 passing therethrough and receiving a pivot pin means 39 therein, the pivot pin means 39 being carried by the frame means 28 and cooperating with the slot means 38 in the latch member 27 to control the movement of the latch member 27 as will be apparent hereinafter.

The slot 38 in the end 34 of the latch member 27 has opposite ends 40 and 41 with an arcuate portion 42 therebetween.

A tension spring 43 has one end 44 interconnected to a tang 45 of the frame plate 30 and the other end 46 thereof interconnected to the end 34 of the latch member 27 whereby the normal force of the tension spring 43 is to tend to hold the latch member 27 so that the pivot pin 39 is at the end 41 of the slot 38 as illustrated in FIG. 2 whereby the latch member 27 is disposed against an edge means 47 of the frame means 21 and being defined by the opening 36 therein.

The drive means 29 comprises a cylinder 48 having opposite ends 49 and 50 and a movable piston means 51 extending out of the end 50 thereof.

While the drive means 29 can comprise any suitable piston and cylinder means for actuating the latch member 27 in the manner previously described and as hereinafter set forth, it is believed that the same can comprise an electro-thermal mechanism which when having an electrical current interconnected thereto, such as from an electrical source 52 illustrated in FIG. 1, will cause the piston means 51 to extend outwardly from the cylinder 48 to a fully extended position thereof as illustrated in FIGS. 6 and 7 and when that electrical current is prevented from reaching the drive means 29, the piston means 51 is adapted to be returned to its fully retracted position as illustrated in FIG. 2 by internal spring means in the cylinder 48. Such electro-thermal actuating mechanisms are fully disclosed in the aforementioned Huebscher U.S. Pat. No. 3,805,528; the Stropkay U.S. Pat. No. 4,095,427 and the Birli, Sr. et al, U.S. Pat. No. 4,887,429, whereby these three U.S. patents are being incorporated into this disclosure by this reference thereto.

Therefore, since the structure and operation of an electro-thermal actuator mechanism is well known in the art, a further discussion of the drive means 29 is deemed unnecessary. However, it is believed that such drive mechanism 29 can be provided with suitable latching structure therein so that when an electrical current is initially directed to the actuator 29 to cause the piston means 51 to be moved to the extended position thereof, the latching structure will latch that piston means 51 in the extended condition thereof so that the electrical source can be disconnected from the drive means 29. Then, when it is desired to retract the piston means 51 from its extended condition, the electrical current is again directed to the drive means 29 which will unlatch the piston means 51 and permit the piston means 51 to be moved to its retracted condition and will be latched in such retracted condition even though the electrical current is subsequently turned off. Such a latching structure for the drive means 29 would be similar to the latching structure for a ball point pin that permits the pin to be selectively extended or retracted relative to its holder.

A bracket 52 is pivotally mounted to the plate 30 by a rivet means 53, the bracket 52 having two legs 54 and receiving the cylinder 48 in a snap-fit manner therebetween so as to carry the drive means 29 and permit the same to pivot relative to the plate 30 so as to permit the pivoting movement of the latch member 27 in a manner hereinafter set forth, the cylinder 48 of the drive means 29 having an annular projection 55 in the medial portion thereof and being received in suitable slots 56 in the legs 54 as illustrated so as to prevent axial movement of the cylinder 48 relative to the legs 54.

The piston means 51 of the drive means 29 has a first part 57 of a certain diameter and an end part 58 of a smaller diameter and passing through a suitable opening means (not shown) in a cylinder member 59 rotatably carried on the end 34 of the latch member 27 in any suitable manner whereby the enlarged part 57 of the piston means 51 abuts the cylinder member 59 and will cause pivoting movement of the latch member 27 as the piston means 51 is being extended from the retracted position of FIG. 2 to its extended position of FIGS. 6 and 7 as will be apparent hereinafter.

The electrical switch means 24 has an actuator 60 and a pivoting lever 61 provided with an end 62 against which a part 63 of the end 34 of the latch member 27 is adapted to engage to move the actuator 60 inwardly to a position to actuate the switch means 24 so that as long as the member 60 of the switch 24 is held in such an actuated condition thereof, an electrical current is adapted to pass through the heater means 23 of the cooking apparatus 20 to heat clean the chamber means 22 in a conventional manner. However, when the actuator 60 is urged outwardly by suitable biasing means (not shown) of the switch means 24 to hold the lever 61 in the position illustrated in FIG. 2, the heating means 23 cannot be utilized to heat clean the chamber 22 of the cooking apparatus 20 for the reasons fully set forth in the aforementioned Genbauffe et al, U.S. Pat. No. 4,927,996.

From the above, it can be seen that the cooking apparatus 20 and the latching construction 26 of this invention can be made by the method of this invention in a relatively simple and effective manner to operate in a manner now to be described.

With the piston means 51 of the drive means 29 being in its retracted condition illustrated in FIG. 2, the tension spring 43 maintains the latch member 27 in the non-latching condition illustrated in FIG. 2 so that the oven door means 25 can be moved to the open and closed conditions thereof and the heating means 23 can be utilized to cook food in the chamber means 22 in a manner well known in the art.

Figure 4:
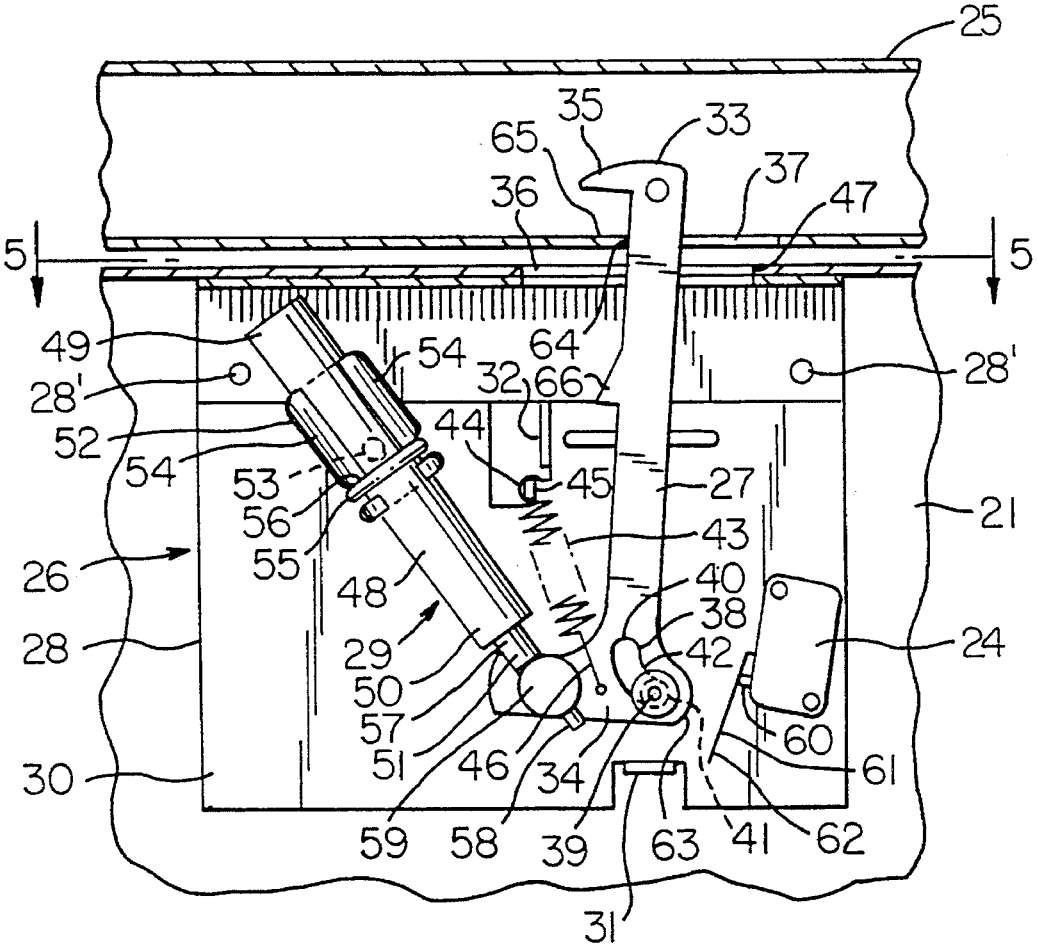
FIG. 4 is a view similar to FIG. 2 and illustrates the latch member having been moved to a position thereof wherein the same initially makes contact with the closed oven door of the cooking apparatus.
Figure 5:
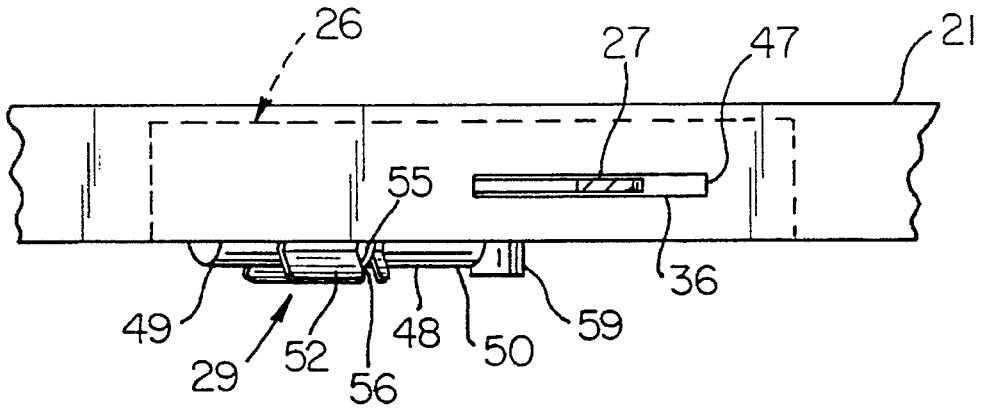
FIG. 5 is a fragmentary cross-sectional view taken on line 5—5 of FIG. 4.

However, when it is desired to heat clean the chamber means 22 of the cooking apparatus 25, the operator closes the oven door 25 to the closed condition illustrated in FIGS. 2 and 4 and then operates a suitable actuator (not shown) of the cooking apparatus 20 to direct the electrical current source 52 to the drive means 29 and cause the piston means 51 thereof to be moved to its fully extended condition. However, as the piston means 51 is being extended from the position illustrated in FIG. 2 to the position illustrated in FIG. 4, the latch member 27 is rotating or pivoting on the pivot pin 39 while that pivot pin 39 is at the end 41 of the slot 48. When the latch member 27 has been pivoted to the position illustrated in FIG. 4 wherein the latch member 27 engages against an edge 64 of the door means 25 that is defined by the opening 37 therein, further clockwise pivoting movement of the latch member 27 is prevented by that edge means 64 so that the extending piston means 51 of the drive means 29 forces the latch member 27 to move downwardly from the position illustrated in FIG. 4 to the position illustrated in FIG. 6 wherein the hook 35 of the latch member 27 compacts against a surface 65 of the oven door 25 to hold the same in its closed condition, such downward movement of the latch member 27 from the position illustrated in FIG. 4 to the position illustrated in FIG. 6 being permitted by the slot 38 wherein the end 34 of the latch member 27 moves downwardly and the pivot pin 39 is received in the upper end 40 of the slot 38 at which time the end 34 of the latch member 27 engages against the tang or abutment 31 and the portion 63 of the end 34 of the latch member 27 engages against the lever 61 of the switch means 24 to hold the actuator 60 in its end condition and thereby actuate the switch 24 to permit electrical current to be received by the heating means 23 to heat clean the chamber means 22 of the cooking apparatus 20 as long as the piston means 51 is in its extended condition.

The drive means 29 maintains the latch member 27 in its locking position as illustrated in FIG. 6 by either having the electrical current continuously supplied to the drive means 29 or by having the drive means 29 itself latch the piston means 51 in its extended condition so that the oven door 25 is locked in its closed condition as long as the switch means 24 is permitting the heating means 23 to heat clean the oven 22.

However, after a certain time period of heat cleaning the oven 22, the control means of the cooking apparatus 20 terminates the heating operation of the heating means 23 in a conventional manner and when the oven has cooled to a certain temperature, such as below approximately 600° F., the drive means 29 either has the electrical current flowing thereto terminated or if the piston 51 has been latched in its extended condition, has an electrical pulse directed to the drive means 29 to permit the same to unlatch itself and permit the piston means 51 to be returned to its retracted condition so that the force of the tension spring 43 returns not only the piston means 51 back to its retracted condition as illustrated in FIG. 2 but also the force of the tension spring 43 causes the latch member 27 to return to its unlatching condition as illustrated in FIG. 2 if internal spring means is not provided in the cylinder 48 whereby the pivot pin 39 is now at the lower end 41 of the slot 38 so that the oven door 25 can be opened and closed as previously described.

However, if during the aforementioned locking operation of the latching construction 26 the oven door 25 is actually in its open condition as illustrated in FIG. 7, then as the drive means 29 is actuated so as to extend its piston means 51, the latch member 27 merely rotates or pivots on the pivot pin 39 while the pivot pin 39 is in the end 41 of the slot 38 until a projection 66 of the latch member 27 strikes against the tang 32 as illustrated in FIG. 7 at which time the piston means 51 is in its fully extended condition and it can be seen that the end portion 63 of the latch member 27 does not engage against the lever 61 of the switch means 24 to actuate the same so that in such position of the latch member 27 of FIG. 7, the heating means 23 can not be utilized to heat clean the chamber 22.

Of course, the latch member 27 can be returned from the third position illustrated in FIG. 7 to the non-latching position illustrated in FIG. 2 by the actuator 29 being operated so as to permit the piston means 51 to return to its retracted condition so that the force of the tension spring 43 will not only return the piston means 51 to its fully retracted position if internal spring means are not provided in the cylinder 48 for such purpose, but will also cause the latch member 27 to move to the non-latching position illustrated in FIG. 2.

Therefore, it can be seen that this invention not only provides a new cooking apparatus and a new method of making such a new cooking apparatus, but also this invention provides a new latching construction for a cooking apparatus and a new method of making such a new latching construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position and actuates said switch if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, the improvement wherein said drive means comprises a cylinder means having opposite ends and a movable piston means extending from one of said opposite ends and comprising said moving means operatively interconnected to said latch member, said drive means having actuating means to extend said piston means so as to be adapted to move said latch member to its said latching position thereof and to retract said piston means so as to be adapted to move said latch member to its said non-latching position thereof, said latch member having an arcuate slot means therein, said frame means having a pivot pin means extending into said arcuate slot means to control the movement of said latch member relative to said frame means by said drive means.

2. A cooking apparatus as set forth in claim 1 wherein said actuating means of said drive means is electrically operated.

3. A cooking apparatus as set forth in claim 2 wherein said actuating means of said drive means comprises an electro-thermal means.

4. A cooking apparatus as set forth in claim 1 wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, said latch member being adapted to actuate said switch means only when said latch member is in said latching position thereof.

5. In a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, the improvement wherein said drive means comprises a cylinder means having opposite ends and a movable piston means extending from one of said opposite ends and comprising said moving means operatively interconnected to said latch member, said drive means having actuating means to extend said piston means so as to be adapted to move said latch member to its said latching position thereof and to retract said piston means so as to be adapted to move said latch member to its said non-latching position thereof, said latch member having an arcuate slot means therein, said frame means having a pivot pin means extending into said arcuate slot means to control the movement of said latch member relative to said frame means by said drive means.

6. A latching construction as set forth in claim 5 wherein said actuating means of said drive means is electrically operated.

7. A latching construction as set forth in claim 6 wherein said actuating means of said drive means comprises an electro-thermal means.

8. A latching construction as set forth in claim 5 wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof.

9. In a method of making a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position and actuates said switch if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, the improvement comprising the steps of forming said drive means to comprise a cylinder means having opposite ends and a movable piston means extending from one of said opposite ends and comprising said moving means operatively interconnected to said latch member, forming said drive means to have actuating means to extend said piston means so as to be adapted to move said latch member to its said latching position thereof and to retract said piston means so as to be adapted to move said latch member to its said non-latching position thereof, forming said latch member to have an arcuate slot means therein, and forming said frame means to have a pivot pin means extending into said arcuate slot means to control the movement of said latch member relative to said frame means by said drive means.

10. A method of making a cooking apparatus as set forth in claim 9 and comprising the step of forming said actuating means of said drive means to be electrically operated.

11. A method of making a cooking apparatus as set forth in claim 9 and comprising the step of forming said actuating means of said drive means to comprise an electro-thermal means.

12. A method of making a cooking apparatus as set forth in claim 9 and comprising the steps of forming said latch member to be movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, and forming said latch member to be adapted to actuate said switch means only when said latch member is in said latching position thereof.

13. In a method of making a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, the improvement comprising the steps of forming said drive means to comprise a cylinder means having opposite ends and a movable piston means extending from one of said opposite ends and comprising said moving means operatively interconnected to said latch member, forming said drive means to have actuating means to extend said piston means so as to be adapted to move said latch member to its said latching position thereof and to retract said piston means so as to be adapted to move said latch member to its said non-latching position thereof, forming said latch member to have an arcuate slot means therein, and forming said frame means to have a pivot pin means extending into said arcuate slot means to control the movement of said latch member relative to said frame means by said drive means.

14. A method of making a latching construction as set forth in claim 13 and comprising the step of forming said actuating means of said drive means to be electrically operated.

15. A method of making a latching construction as set forth in claim 14 and comprising the step of forming said actuating means of said drive means to comprise an electro-thermal means.

16. A method of making a latching construction as set forth in claim 13 and comprising the step of forming said latch member to be movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof.

* * * * *